United States Patent [19]

Urrea et al.

[11] Patent Number: 5,000,096

[45] Date of Patent: Mar. 19, 1991

[54] ARTICULATED VEHICLE, SUCH AS AN EXTRA-LONG RAILWAY CAR INTENDED FOR TRANSPORTING AUTOMOBILES

[76] Inventors: Robert Urrea, 27 rue Viret, 69100 Villeurbanne; Daniel Grandjean, Menival, Les Gravieres, Tour No. 11, 69800 St. Priest, both of France

[21] Appl. No.: 317,588

[22] Filed: Mar. 1, 1989

[30] Foreign Application Priority Data

Mar. 2, 1988 [FR] France ..... 88 02977

[51] Int. Cl.[5] ..... B61F 3/12; B61D 3/10; B61D 3/18

[52] U.S. Cl. ..... 105/4.1; 105/3

[58] Field of Search ..... 105/3, 4.1, 4.3, 4.2, 105/175.1; 410/45

[56] References Cited

U.S. PATENT DOCUMENTS

| | | | |
|---|---|---|---|
| 1,886,185 | 9/1932 | Willoughby . | |
| 3,513,592 | 5/1970 | Ernst | 105/4.1 |
| 3,845,724 | 11/1974 | Boocock et al. | 105/164 |

FOREIGN PATENT DOCUMENTS

| | | | |
|---|---|---|---|
| 1163361 | 2/1964 | Fed. Rep. of Germany . | |
| 1963679 | 2/1979 | Fed. Rep. of Germany | 105/4.1 |
| 2086846 | 12/1971 | France . | |
| 2278550 | 2/1976 | France . | |
| 2409896 | 6/1979 | France . | |
| 2491849 | 10/1980 | France . | |
| 0154012 | 8/1932 | Switzerland | 105/4.1 |

*Primary Examiner*—Andres Kashnikow
*Assistant Examiner*—Mark T. Le
*Attorney, Agent, or Firm*—Kerkam, Stowell, Kondracki & Clarke

[57] ABSTRACT

The invention relates to an articulated vehicle intended for the railway transport of vehicles and characterized in that front and rear planes ($P_1$, $P_2$) transverse to the underframe and each including the shafts of front or rear transoms are notably distinct from the front and rear planes ($P_3$, $P_4$) transverse to the underframe and each including the shaft of the front or rear pivot.

19 Claims, 2 Drawing Sheets

ARTICULATED VEHICLE, SUCH AS AN EXTRA-LONG RAILWAY CAR INTENDED FOR TRANSPORTING AUTOMOBILES

BACKGROUND OF THE INVENTION

1. Field of the Invention

The invention relates to an articulated vehicle, more particularly, but not exclusively to a very long railway car for transporting automobiles.

If railway vehicles are to meet the load limit gauge imposed upon them when they travel around curves, the distance between the end axles of a car must be limited, which for a given total loading area in a train multiplies the number of cars required.

The space needed for coupling and for the traction and buffing means for independent cars notably reduces the total loading area of the train.

2. Description of the Prior Art

In order to overcome this disadvantage, articulated railway vehicles comprising two half-frames have appeared; each half-frame is comparable in length to the frame of one independent railway vehicle, and is provided with its own rolling devices at the far ends, while at its other end, each half-frame is supported directly or indirectly on an intermediate underframe provided with rolling devices shared by both half-frames.

In currently known embodiments, the half-frames are connected to one another by a pivot carried by the underframe; the pivot either comprises a shaft on which the ends of the underframe are threaded (French Patent 2.409.896) or comprises concentric rings of large diameter carried by the half-frames and cooperating with at least one ring carried by the underframe (French Patent 2.491.849).

In the case of a single shaft, this generally assures only rotational guidance; load-bearing is then effected by the lateral support.

Since the underframe is connected to the half-frame only by a central pivot, the central portion of the car lacks stability in motion.

To overcome this disadvantage and moreover to increase the length of each half-frame, an articulated vehicle is known (French Patent 2.086.846) of which the half-frames are on the one hand connected to one another by a spherical plain bearing and on the other hand are rotatably connected to the underframe, not about the same shaft as that of this spherical plain bearing but rather about one of the two separate pivots carried by the underframe in the longitudinal plane thereto and spaced apart equidistantly from the spherical plain bearing and the median transverse plane of the underframe.

Elastic elements naturally absorb the deflection in the arcs on which the half-frames can pivot with respect to the underframe.

This connection of the underframe by two pivots increases the stability of the car in motion, makes it possible to lower the floor of the car, and finally allows an increase in the useful length of the car by the value of the spacing between the two pivots.

To make profitable use of this latter advantage, known embodiments (French Patent 2.086.846) have located the pivots in proximity with the opposite ends of the underframe, and loading takes place on the lateral supports generally known as transoms, which both on the underframe and in embodiments have a single central pivot are disposed substantially in the same transverse plane as the pivot they supplement.

This type of embodiment has given excellent results for articulated vehicles with a single common axle, which are therefore reserved for light loads, but has led to excessive flexibility in the articulation of heavily loaded cars.

One object that the invention seeks to obtain is an articulated vehicle of the above type that is suitable for heavy loads.

SUMMARY OF THE INVENTION

To this end, the subject invention is an articulated vehicle, characterized in particular in that the front and rear planes transverse to the underframe, each including the shafts of the front or rear transoms, are clearly distinct from the front and rear planes transverse to the underframe, each including the shaft of the front or rear pivot.

BRIEF DESCRIPTION OF THE DRAWING

The invention will be better understood with the aid of the ensuing description, made by way of non-limiting example, in conjunction with the accompanying drawing, which schematically shows the following.

DESCRIPTION OF THE PREFERRED EMBODIMENT

Figure 1:
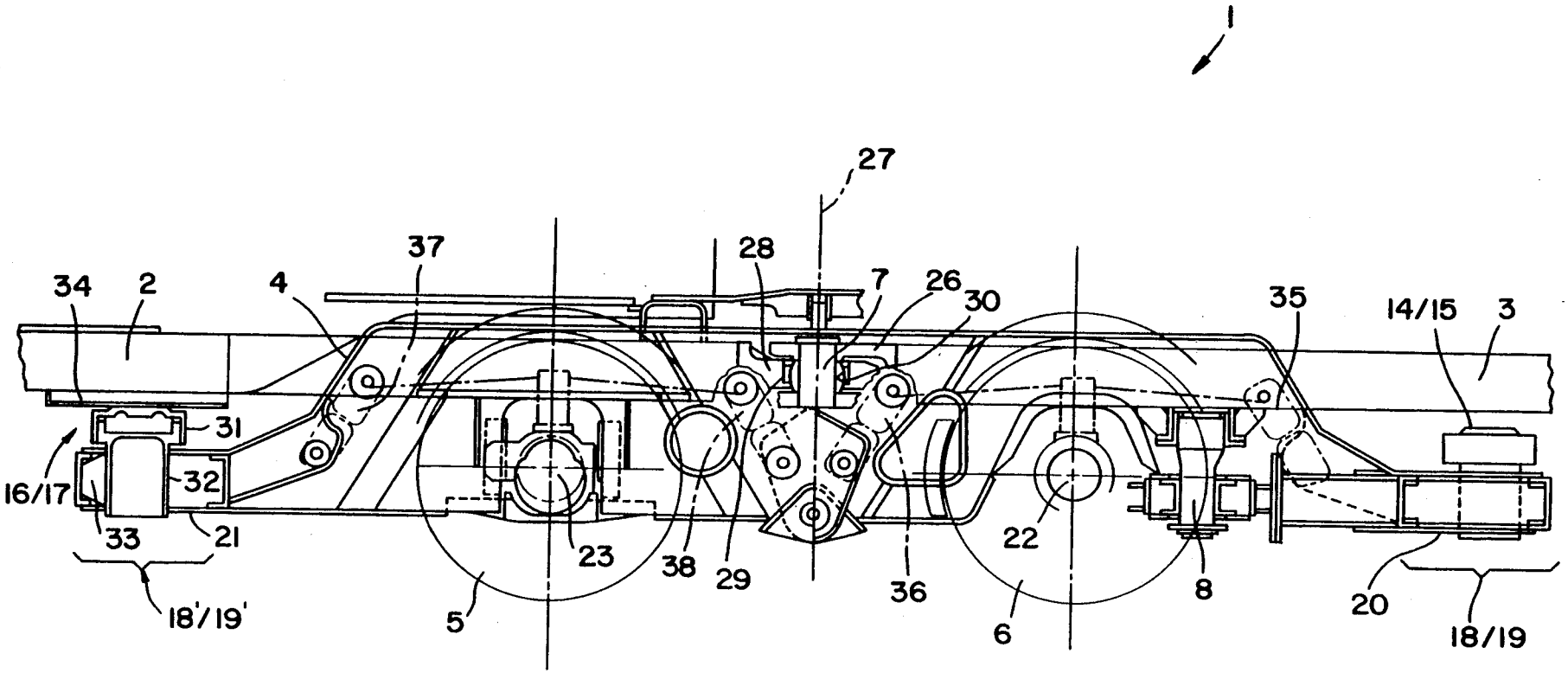
FIG. 1 is a fragmentary view in profile of the articulated vehicle.
Figure 2:
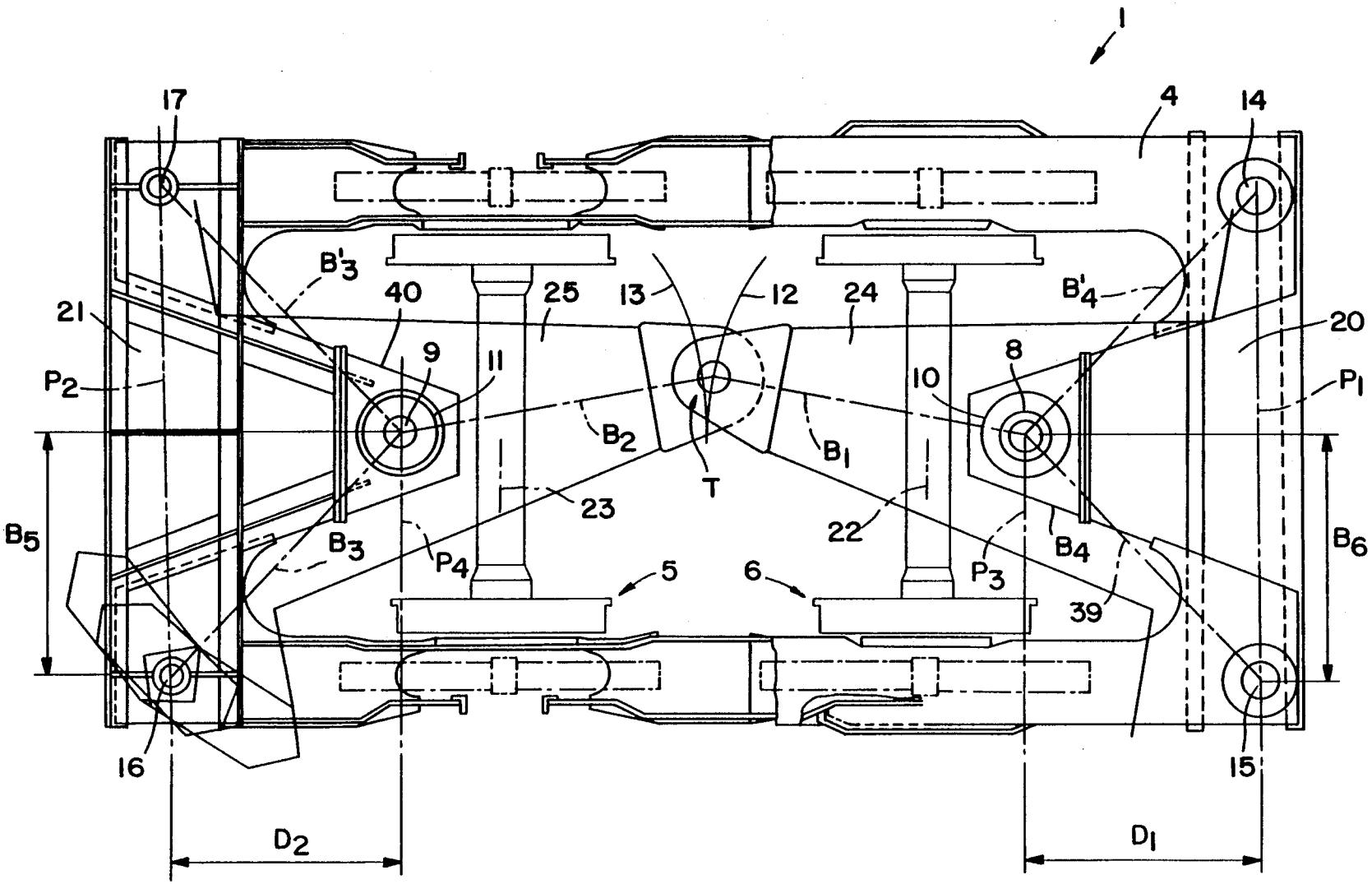
FIG. 2 is a fragmentary view from above of the articulated vehicle.

Turning to the drawing, it is seen that the articulated vehicle 1 comprises two half-frames 2, 3, provided with their own rolling devices (not shown) at one of their facing ends and at their other end being supported on an underframe 4 provided with rolling devices 5, 6 that are common to the two half-frames 2, 3.

The two half-frames 2, 3 are connected to one another by a spherical plan bearing 7 and are rotatably connected to the underframe 4, each about one of the two (front and rear) pivots 8, 9 carried for this purpose by the underframe 4 in the plane longitudinal to the underframe 4; the pivots are equidistant, on the half-frames, from the spherical plane bearing 7 and, on the underframe 4, from the median transverse plane of this underframe 4.

Elastic devices 10, 11 absorb the deflection on the arcs 12, 13 on which the half-frames 2, 3 can pivot with respect to the underframe 4.

On each of the facing ends of the half-frames, the load is borne by the underframe 4 on lateral transom supports including shafts 14, 15, 16 and 17 in the front and rear, respectively.

In an essential characteristic of the invention, the front and rear, or first and second, respectively planes $P_1$, $P_2$ transverse to the longitudinal axis of the underframe and each including the shafts of the front or rear transoms are clearly distinct from the corresponding front and rear or third and fourth, respectively planes $P_3$, $P_4$ transverse to the longitudinal axis of the underframe and each including the shaft of the front or rear pivot.

The distance $D_1$ or $D_2$ separating the planes $P_1$, $P_3$ or $P_2$, $P_4$, respectively, containing the shafts of the front or rear transoms and the shaft of the front or rear pivot, is such that the length of the lever arms $B_3$ and $B'_3$ or $B_4$ and $B'_4$ between each pivot 8, 9 and the shafts 14 and 15 or 16 and 17 of the transoms that supplement it are markedly increased (that is greater than) with respect to their typical value $B_5$, $B_6$ measured parallel to the transverse planes.

Preferably, they are substantially equal to the length of the lever arms $B_1$, $B_2$ formed between the spherical bearing 7 and each pivot 8, 9.

Advantageously, the transverse planes $P_1$, $P_2$ of the transoms are located at a greater distance from the spherical bearing than are the transverse planes $P_3$, $P_4$ of the pivots, and the transoms are carried by extensions 18, 19, 18', 19' of the frame plates or said frames 20, 21 of the underframe.

These extensions 18, 19, 18', 19' are sufficiently distant from the axles 22, 23 of the rolling devices to be disengaged from the rolling devices, suspension devices and braking devices, which enables them to be lowered and as a consequence makes it possible to lower the platform of the half-frame.

The spacing apart of the transoms increases the size of the polygon on which the median portion of the vehicle rests and reinforces its stability.

The lengthening of the lever arms $B_3$, $B'_3$ and $B_4$, $B'_4$ formed between the pivots and their transoms increases the load capability that can be handled by the transoms and makes the articulation of the vehicle less flexible, which also increases its stability.

In a preferred embodiment, the ends of the half-frames articulately connected to one another each form a jib 24, 25, one of which is terminated by a cap 26 having a vertical axis 27 passing through a protrusion 28 carried by the other jib. The bore 29 of the other jib cooperates with a spherical bearing 30 disposed along axis 27.

Each of the transom shaft supports 14-17 comprise flexible transoms including, on the one hand, a plate 31 carried by a foot 32 engaging a damper block 33 fixed to the underframe and, on the other hand, a sole plate 34 carried at a suitable well placed predetermined location by the half-frame.

By the intermediary of the elastic devices 10, 11 mentioned above, the pivots 8, 9 are each carried by one platform 39 or 40 of the underframe.

The underframe will be understood to further include its own suspension, for example including connecting rods 35–38 having an axis transverse to the underframe and provided with a block of elastic means such as the blocks known by the trademark "Silentbloc" made of elastic material.

We claim:

1. An articulated vehicle (1) for railway transport of automobiles comprising two half-frames (2, 3) adapted to be supported at one of their ends with their own rolling devices and at their other facing ends on an underframe (4) common with the two half-frames (2, 3) and having rolling devices (5, 6), said two half-frames (2, 3) being connected to one another by a spherical roller bearing (7) and connected in rotation with the underframe (4), each about one of two front and rear pivots (8, 9) carried by the underframe (4) in a plane along the longitudinal axis of the underframe and equidistant, on the half-frames, from the spherical roller bearing (7) and, on the underframe (4), from a median transverse plane of this underframe (4), said pivots (8, 9) including elastic means (10, 11) for absorbing the deflection of an arc (12, 13) on which the half-frames (3, 3) can pivot with respect to the underframe (4), said underframe (4) having spaced first and second lateral transom supports including shafts (14 and 15 or 16 and 17) disposed at each of the facing ends of the half-frame such that the load on each of the facing ends is borne by said first and second lateral transom supports of said underframe, said vehicle being characterized in that there are included first and second planes ($P_1$ $P_2$) transverse to the longitudinal axis of the underframe and each including the shafts of first and second lateral transom supports, said first and second planes being distinct from third and fourth planes ($P_3$, $P_4$) transverse to the longitudinal axis of the underframe and each third and fourth plane including a shaft forming the two pivots (8, 9).

2. A vehicle as defined by claim 1, characterized in that the first and third planes (P1, P2) are separated by a distance and the second and fourth planes (P2, P4) are also separated by said distance, said distance being characterized in that the length of a level arm (B3, B'3, B4, B'4) interconnecting one of said pivots (8,9) and one of the associated shafts (14,15,16,17) of the transom supports is greater than the distance between said one pivot (8,9) and said one associated shaft (14,15,16,17) measured parallel to the transverse planes.

3. A vehicle as defined by claim 2, characterized in that the length of the lever arms ($B_3$, $B_4$, $B_3$ and $B^4$) interconnecting the pivots (8, 9) and the associated shafts of the transom supports (14 and 15 or 16 and 17) is substantially equal to the length of lever arms (B1, $B_2$) formed between the spherical bearing (7) and the two pivots (8, 9).

4. A vehicle as defined by claim 1, characterized in that the first and second planes ($P_1$, $P_2$) of the transom supports are located at a greater distance from the spherical bearing than the third and fourth planes ($P_3$, $P_4$) of the pivots.

5. A vehicle as defined by claim 2, characterized in that the first and second planes ($P_1$, $P_2$) of the transom supports are located at a greater distance from the spherical bearing than the third and fourth planes ($P_3$, $P_4$) of the pivots.

6. A vehicle as defined by claim 3, characterized in that the planes ($P_1$, $P_2$) of the transom supports are located at a greater distance from the spherical bearing than the planes ($P_3$, $P_4$) of the pivots.

7. A vehicle as defined by claim 1, characterized in that the transom supports are carried by extensions (18, 19, 18', 19') of frame plates (20, 21) of the underframe.

8. A vehicle as defined by claim 2, characterized in that the transom supports are carried by extensions (18, 19, 18', 19') of frame plates (20, 21) of the underframe.

9. A vehicle as defined by claim 3, characterized in that the transom supports are carried by extensions (18, 19, 18', 19') of frame plates (20, 21) of the underframe.

10. A vehicle as defined by claim 4, characterized in that the transom supports are carried by extensions (18, 19, 18', 19') of frame plates (20, 21) of the underframe.

11. A vehicle as defined by claim 1, characterized in that the facing ends of the half-frames articulate with one another and each forms a jib (24, 25), one of which jib is terminated by a cap (26) having a vertical axis (27) passing through a protrusion (28) carried by the other jib, and the other jib having a bore (29) which cooperates with a spherical bearing (30) disposed along the vertical axis (27).

12. A vehicle as defined by claim 2, characterized in that the facing ends of the half-frames articulate with one another and each forms a jib (24, 25), one of which jib is terminated by a cap (26) having a vertical axis (27) passing through a protrusion (28) carried by the other jib, and the other jib having a bore (29) which cooperates with a spherical bearing (30) disposed along the vertical axis (27).

13. A vehicle as defined by claim 3, characterized in that the facing ends of the half-frames articulate with one another and each forms a jib (24, 25), one of which jib is terminated by a cap (26) having a vertical axis (27) passing through a protrusion (28) carried by the other jib, and the other jib having a bore (29) which cooperates with a spherical bearing (30) disposed along the vertical axis (27).

14. A vehicle as defined by claim 4, characterized in that the facing ends of the half-frames articulate with one another and each forms a jib (24, 25), one of which jib is terminated by a cap (26) having a vertical axis (27) passing through a protrusion (28) carried by the other jib, and the other jib having a bore (29) which cooperates with a spherical bearing (30) disposed along the vertical axis (27).

15. A vehicle as defined by claim 1, characterized in that each of said transom supports including said shafts (14–17) includes on the one hand a plate (31) carried by a foot (32) engaging a damper block (33) fixed to the underframe and on the other hand a sole plate (34) carried at a predetermined location by the half-frame.

16. A vehicle as defined by claim 2, characterized in that each of said transom supports including said shafts (14–17) includes on the one hand a plate (31) carried by a foot (32) engaging a damper block (33) fixed to the underframe and on the other hand a sole plate (34) carried at a predetermined location by the half-frame.

17. A vehicle as defined by claim 3, characterized in that each of said transom supports including said shafts (14–17) includes on the one hand a plate (31) carried by a foot (32) engaging a damper block (33) fixed to the underframe and on the other hand a sole plate (34) carried at a predetermined location by the half-frame.

18. A vehicle as defined by claim 4, characterized in that each of said transom supports including said shafts (14–17) includes on the one hand a plate (31) carried by a foot (32) engaging a damper block (33) fixed to the underframe and on the other hand a sole plate (34) carried at a predetermined location by the half-frame.

19. A vehicle as defined by claim 1, characterized in that the pivots (8, 9) are carried by the underframe, each via a platform (39 or 40) supported by connecting rods (35–38) having an axis transverse to the underframe provided with a block of elastic means (10, 11) for absorbing the deflection of the arcs (12, 13).

* * * * *